US011293331B1

(12) United States Patent
Toriizuka

(10) Patent No.: US 11,293,331 B1
(45) Date of Patent: Apr. 5, 2022

(54) COVER STRUCTURE FOR AIR-COOLED ENGINE

(71) Applicant: KAWASAKI JUKOGYO KABUSHIKI KAISHA, Kobe (JP)

(72) Inventor: Ren Toriizuka, Kobe (JP)

(73) Assignee: KAWASAKI JUKOGYO KABUSHIKI KAISHA

( * ) Notice: Subject to any disclaimer, the term of this patent is extended or adjusted under 35 U.S.C. 154(b) by 0 days.

(21) Appl. No.: 17/062,942

(22) Filed: Oct. 5, 2020

(51) Int. Cl.

| | |
|---|---|
| ***F01P 5/02*** | (2006.01) |
| ***F01P 11/10*** | (2006.01) |
| ***F01P 5/06*** | (2006.01) |
| ***F02F 7/00*** | (2006.01) |
| ***F01P 1/02*** | (2006.01) |

(52) U.S. Cl.
CPC *F01P 5/06* (2013.01); *F01P 1/02* (2013.01); *F02F 7/0073* (2013.01); *F01P 2001/023* (2013.01)

(58) Field of Classification Search
CPC ..... F01P 5/02; F01P 5/06; F01P 11/10; F01P 1/06; F01P 11/12
See application file for complete search history.

(56) References Cited

U.S. PATENT DOCUMENTS

| | | | | |
|---|---|---|---|---|
| 5,992,393 | A * | 11/1999 | Yoshida | F02M 39/00 123/509 |
| 7,958,855 | B2 | 6/2011 | Nakamizo | |
| 2004/0154559 | A1* | 8/2004 | Geisheker | F01P 5/06 123/41.56 |
| 2006/0169256 | A1* | 8/2006 | Lavender | F02M 35/08 123/559.1 |
| 2008/0127914 | A1* | 6/2008 | Nakashima | F01P 5/06 123/41.65 |
| 2009/0293835 | A1* | 12/2009 | Nakamizo | F02M 35/08 123/198 E |
| 2013/0024099 | A1* | 1/2013 | Nakajima | F02D 35/027 701/111 |
| 2014/0053793 | A1* | 2/2014 | Sullivan | F04D 17/16 123/41.65 |
| 2017/0044941 | A1* | 2/2017 | Nishi | F01M 11/0004 |
| 2018/0119793 | A1* | 5/2018 | Doveri | F16H 57/0489 |

* cited by examiner

*Primary Examiner* — Long T Tran

(57) ABSTRACT

Provided is a cover structure for an air-cooled engine to be cooled by cooling air generated by a cooling fan, the cover structure including: a fan housing covering the cooling fan and configured to guide the cooling air to a cylinder unit, the fan housing being formed with an opening part for maintenance of the cylinder unit; and a debris cover removably attached to the fan housing so as to close the opening part. The fan housing is formed with an air guide plate that constitutes a part of an outer periphery of the fan housing. The air guide plate includes a proximal end portion and a distal end portion extending from the proximal end portion to a cooling fin of the cylinder unit. A reinforcing plate for securing rigidity of the fan housing is formed at the proximal end portion of the air guide plate.

15 Claims, 6 Drawing Sheets

COVER STRUCTURE FOR AIR-COOLED ENGINE

BACKGROUND OF THE INVENTION

Field of the Invention

The present invention relates to a cover structure for an air-cooled engine to be cooled by cooling air generated by a cooling fan.

Description of Related Art

For example, an air-cooled engine used in e.g. mowers has been known in which a fan housing covers a cooling fan and is provided with an opening for maintenance. Such an opening is openable and closable by a debris cover. The debris cover can be detached upon maintenance so that grass clippings caught by a cylinder head can be removed.

In terms of ease of maintenance, the opening preferably has larger dimensions. However, a larger opening may result in decrease in rigidity of the fan housing.

SUMMARY OF THE INVENTION

An object of the present invention is to provide a cover structure for an air-cooled engine, the cover structure having a large opening so as to facilitate maintenance while ensuring rigidity of a fan housing.

In order to achieve the above object, a cover structure for an engine according to the present invention is a cover structure for an air-cooled engine to be cooled by cooling air generated by a cooling fan, the cover structure including:

- a fan housing covering the cooling fan and configured to guide the cooling air to a cylinder unit, the fan housing being formed with an opening part for maintenance of the cylinder unit;
- a debris cover removably attached to the fan housing so as to close the opening part;
- an air guide plate formed with in the fan housing and configured to constitute a part of an outer periphery of the fan housing, the air guide plate including a proximal end portion and a distal end portion extending from the proximal end portion to a cooling fin of the cylinder unit; and
- a reinforcing plate for securing rigidity of the fan housing, the reinforcing plate being formed at the proximal end portion of the air guide plate.

According to this configuration, the fan housing is formed with the air guide plate constituting a part of an outer periphery of the fan housing; the distal end portion of the air guide plate extends to the cooling fin of the cylinder unit; and the reinforcing plate is formed at the proximal end portion of the air guide plate. Thus, even where a larger opening is provided in order to facilitate maintenance, the rigidity of the fan housing is ensured thanks to the air guide plate and the reinforcing plate. The air guide plate also improves cooling of the engine.

In the present invention, the debris cover may have a rear surface formed with a rib to be engaged with the opening part. According to this configuration, the rib improves the rigidity of the debris cover and serves as a guide when attaching the debris cover, and therefore, workability in attaching the debris cover can also be improved. The rib can also suppress leakage of air from the opening so that cooling is improved.

In the present invention, the cover structure may further include a screen cover removably attached to the fan housing by a fastening member and configured to prevent foreign matters from approaching the cooling fan, and a head part of the fastening member may be concealed by the debris cover. This configuration provides good appearance since the fastening member is not exposed, and also prevents contact with peripheral components so that the fastening member is less likely to become loose, making it possible to suppress detachment of the screen cover.

In the present invention, the engine may include a fuel nozzle disposed on a side opposite to a rotation shaft of the engine with respect to the air guide plate, and an intake-side cover may be disposed on an outer side of the fuel nozzle so as to cover the fuel nozzle. According to this configuration, the fuel nozzle is located on the outer side of the fan housing, and therefore, maintenance of the fuel nozzle can be facilitated.

In the present invention, the engine may be a V-type engine having two cylinders each having the cylinder unit, and the fan housing may have two said opening parts facing the cylinder units of the cylinders. This configuration makes it easy to remove grass clippings accumulated on the cooling fins through the opening parts.

In this case, an oil cooler may be disposed in the vicinity of a cooling air outlet on an outer wall of the fan housing. According to this configuration, the cooling air is guided to the oil cooler so as to effectively cool the oil cooler.

In this case, the distal end portion of the air guide plate may extend to respective cooling fins of the two cylinders. According to this configuration, the cooling air from the fan can be efficiently guided to the cooling fins of the respective cylinders so that cooling is improved.

In this case, the distal end portion of the air guide plate may be disposed closer to exhaust ports of the cylinder units than to intake ports of the cylinder units. This configuration makes it possible to efficiently guide the cooling air to parts of the cooling fins, which parts are located in the vicinity of the exhaust ports and have a higher temperature, and therefore, cooling is improved.

In the present invention, the cooling fan may be a centrifugal fan configured to feed the cooling air radially outward from the rotation shaft of the engine in a radiating manner. According to this configuration, the air guide plate can smoothly guide the cooling air.

In this case, the engine may be a V-type engine having two cylinders each having the cylinder unit; the air guide plate may include a pair of collecting walls configured to collect a part of the cooling air flowing from the centrifugal fan in the radiating manner and to distribute the collected cooling air to the two cylinder units; and each of the pair of collecting walls may be curved so as to extend away from a rotation shaft of the centrifugal fan in a circumferential direction of a rotation direction of the centrifugal fan. According to this configuration, the snail-shaped collecting walls matching the two cylinder units can rectify the cooling air radiated by the centrifugal fan in a centrifugal direction and distribute the cooling air to both the cylinders, and therefore, cooling is improved.

In this case, the air guide plate may include a pair of impingement walls provided correspondingly to the pair of collecting walls; and the pair of impingement walls may be disposed to confront the corresponding collecting walls with cylinder-opposing regions extending along axes of the cylinders being positioned therebetween, the pair of impingement walls being configured to deflect the cooling air collected by the collecting walls so as to guide the cooling air along the cylinder-opposing regions. According to this configuration, provision of the impingement walls makes it easy to deflect the collected cooling air so as to guide the cooling air in the directions along the cylinder axes. As a result, cooling is improved.

In this case, the collecting walls may include a first collecting wall configured to distribute the cooling air to one of the cylinder units and a second collecting wall configured to distribute the cooling air to the other of the cylinder units; the impingement walls may include a first impingement wall formed in the first collecting wall and a second impingement wall formed in the second collecting wall; the first collecting wall and the second impingement wall may be connected to each other, and the second collecting wall and the first impingement wall may be connected to each other. According to this configuration, since the collecting walls and the impingement walls are connected to each other, they are formed as constituting members of the outer periphery of the fan housing, and also, the rigidity of the fan housing can be enhanced.

In the present invention, the debris cover may extend over the air guide plate to a side opposite to the rotation shaft of the engine when viewed from an axial direction of the rotation shaft of the engine. According to this configuration, the debris cover extends over the air guide plate, and therefore, the debris cover can protect the fuel nozzle etc.

In the present invention, the debris cover may have a surface formed with a stepped part. According to this configuration, the stepped part improves the rigidity of the debris cover.

The present invention encompasses any combination of at least two features disclosed in the claims and/or the specification and/or the drawings. In particular, any combination of two or more of the appended claims should be equally construed as included within the scope of the present invention.

BRIEF DESCRIPTION OF THE DRAWINGS

The present invention will be more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views:

DESCRIPTION OF THE EMBODIMENTS

Figure 1:
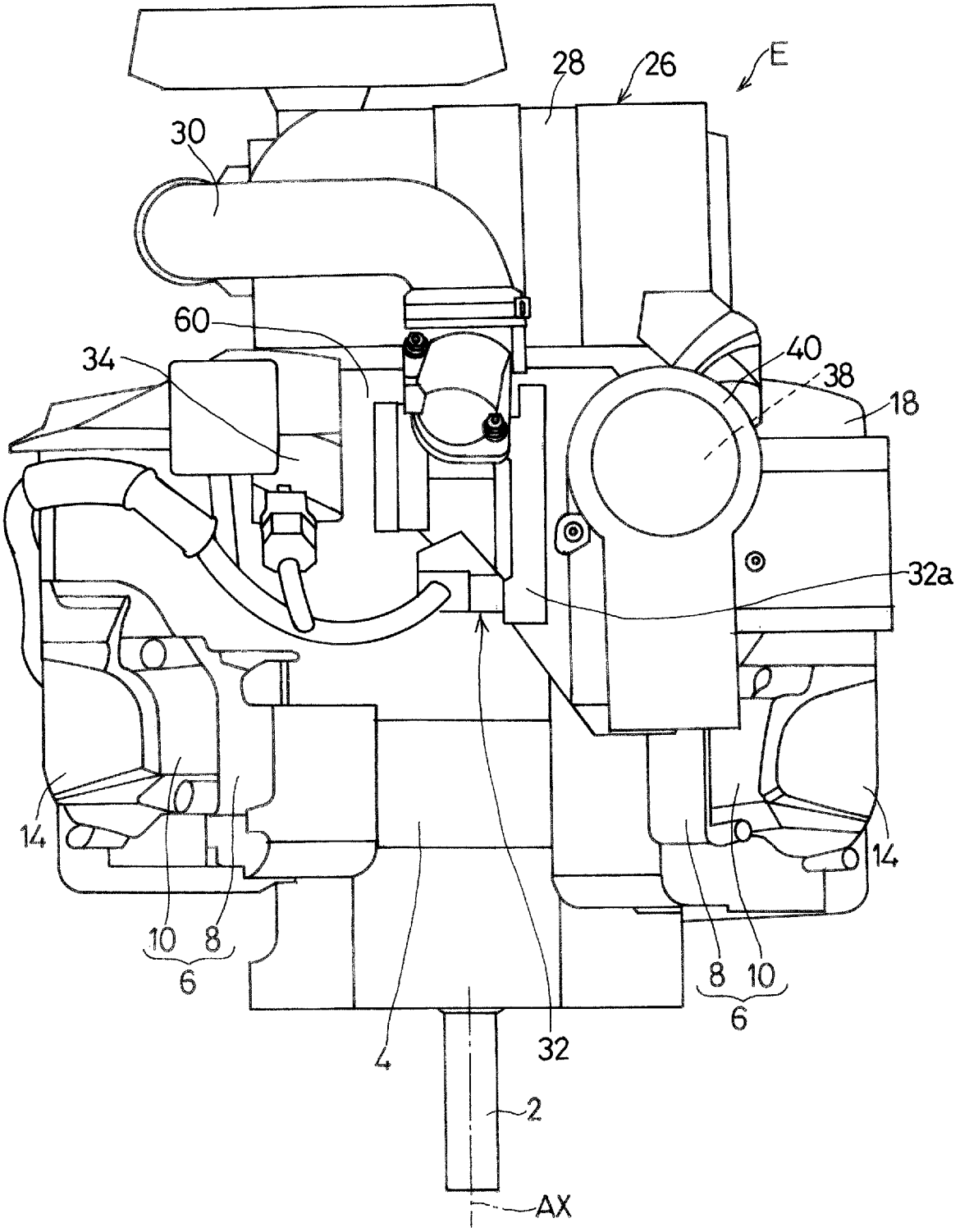
FIG. 1 is a front view of an air-cooled engine including a cover structure according to a first embodiment of the present invention.

Hereinafter, a preferred embodiment of the present invention will be described with reference to the drawings. In FIG. 1, an engine E including a cover structure according to a first embodiment of the present invention is a so-called V-type engine in which cylinder axes A1 of two cylinder units 6 extend in a V shape. The engine E of the present embodiment is an air-cooled vertical-twin engine. For example, the engine is mounted in a riding mower such that a rotation shaft of the engine extends in a vertical direction. Note that the type and application of the engine E are not limited to this example. In the following description, the term "front" and the like refer to a V-bank side, i.e., a direction in which the V shape is opened in a state where the engine is mounted in a machine (for example, a mower or an agricultural machine), and the term "rear" and the like refer to the opposite side. Also, the "vertical direction" and the like refer to an axial direction of the rotation shaft, and the "widthwise direction" and the like refer to a direction perpendicular to both of the vertical direction and the front/rear direction.

The engine E of the present embodiment includes: a crankshaft 2 (one example of the engine rotation shaft) having an axis AX extending in the vertical direction in a state where the engine is mounted; a crankcase 4 supporting the crankshaft 2; and a pair of cylinder units 6, 6 protruding frontward from a front part of the crankcase 4. The crankshaft 2 has a lower end portion to which a power transmission member for transmitting power to a work tool is attached.

Figure 4:
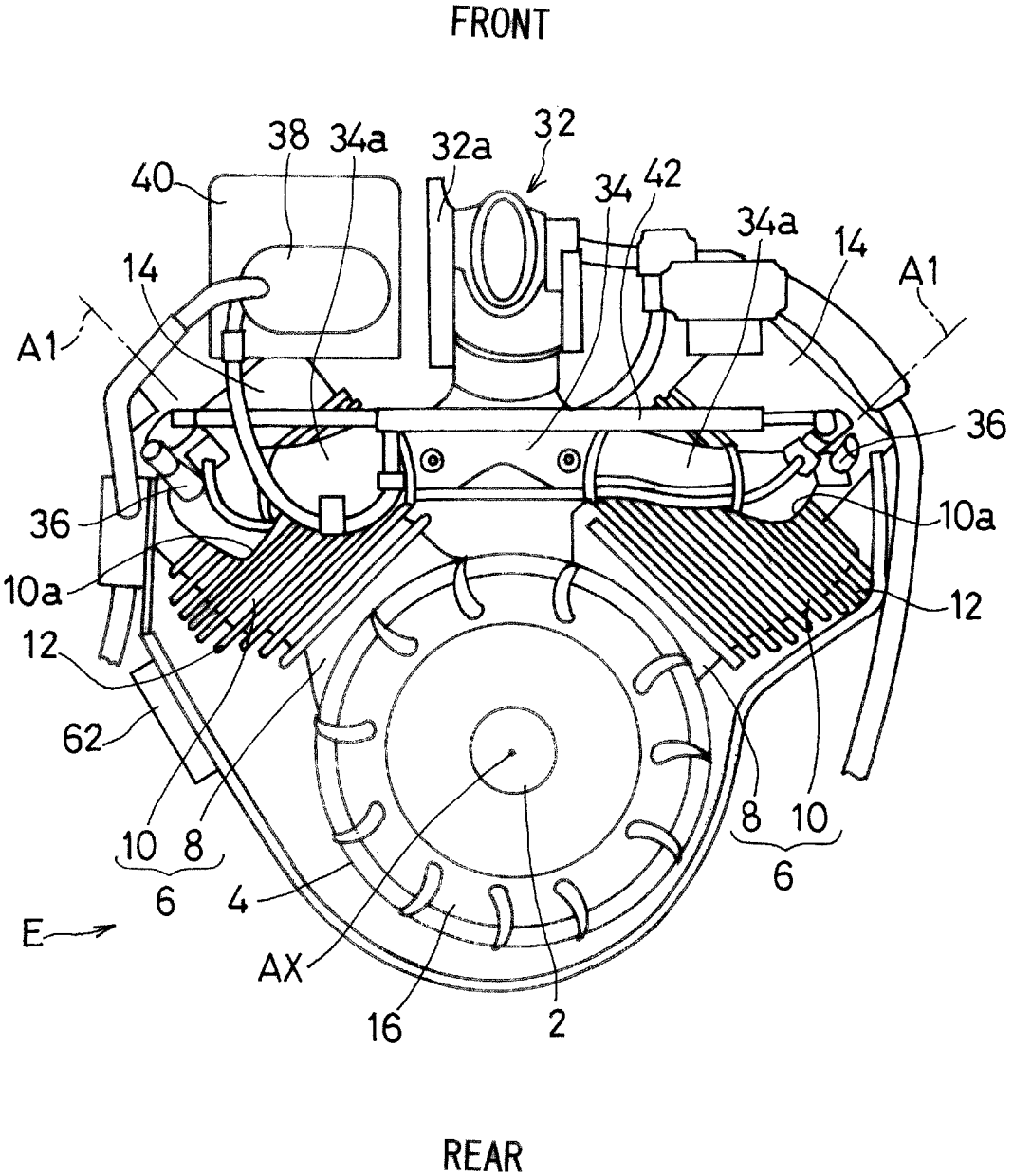
FIG. 4 is a plan view of the engine, with a housing removed.

Each cylinder unit 6 includes: a cylinder 8 having a proximal end portion coupled to the crankcase 4; and a cylinder head 10 coupled to a protruding end portion of the cylinder 8. As shown in FIG. 4, each cylinder unit 6 has a cylinder axis A1 extending frontward and outward in a widthwise direction of the engine in a slant manner. The cylinder axes A1 of the two cylinder units 6 define a V shape opened frontward.

A cooling fin 12 is formed on an outer periphery of each cylinder unit 6. The cooling fin 12 provides an increased surface area so that the cooling effect of the air-cooled engine is improved. A head cover 14 is to attached to a front end of each cylinder unit 6. Each cylinder head 10 is formed with an intake port 10*a* on one side in an axial direction AX of the engine rotation shaft 2 (on an upper side in the present embodiment) and an exhaust port 10*b* (FIG. 6) on the other side (on a lower side in the present embodiment). Intake system components, which will be described later, are connected to the intake ports 10*a*, and exhaust system components (not illustrated) such as an exhaust pipe and an exhaust muffler are connected to the exhaust ports 10*b*.

Figure 2:
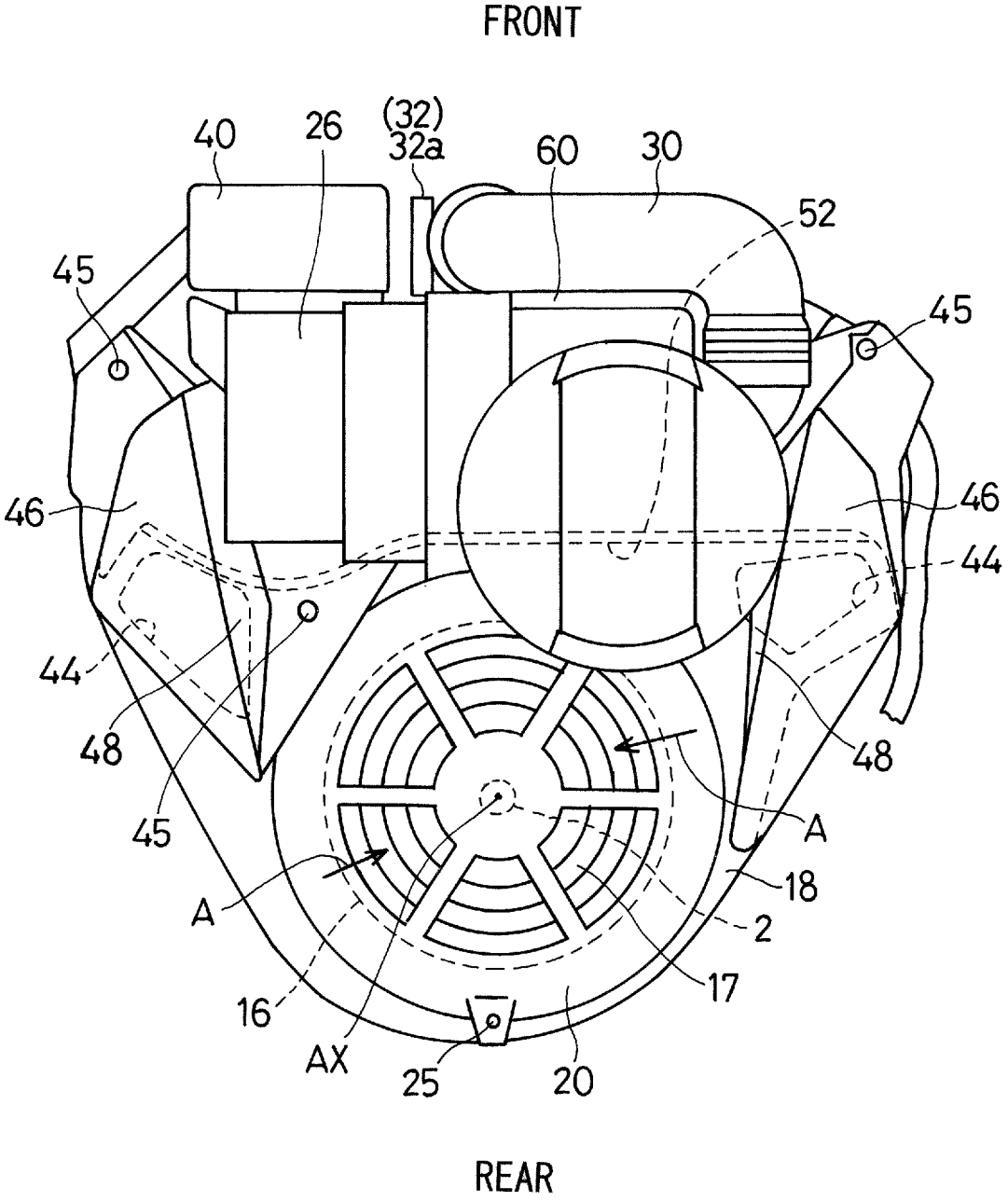
FIG. 2 is a plan view of the engine.

A cooling fan 16 is attached to an upper end of the crankshaft 2. A rotary screen 17 shown in FIG. 2 is attached to an upper end of the cooling fan 16. Cooling air W generated by the cooling fan 16 cools the cylinder units 6. The cooling fan 16 is disposed on one side with respect to the cylinder units 6 (above the cylinder units in the present embodiment) in an axial direction AX of the engine rotation shaft 2. The cooling fan 16 of the present embodiment is a centrifugal fan that feeds the cooling air W radially outward from the engine rotation shaft 2 in a radiating manner. The cooling fan 16, however, is not limited to this example.

Figure 3:
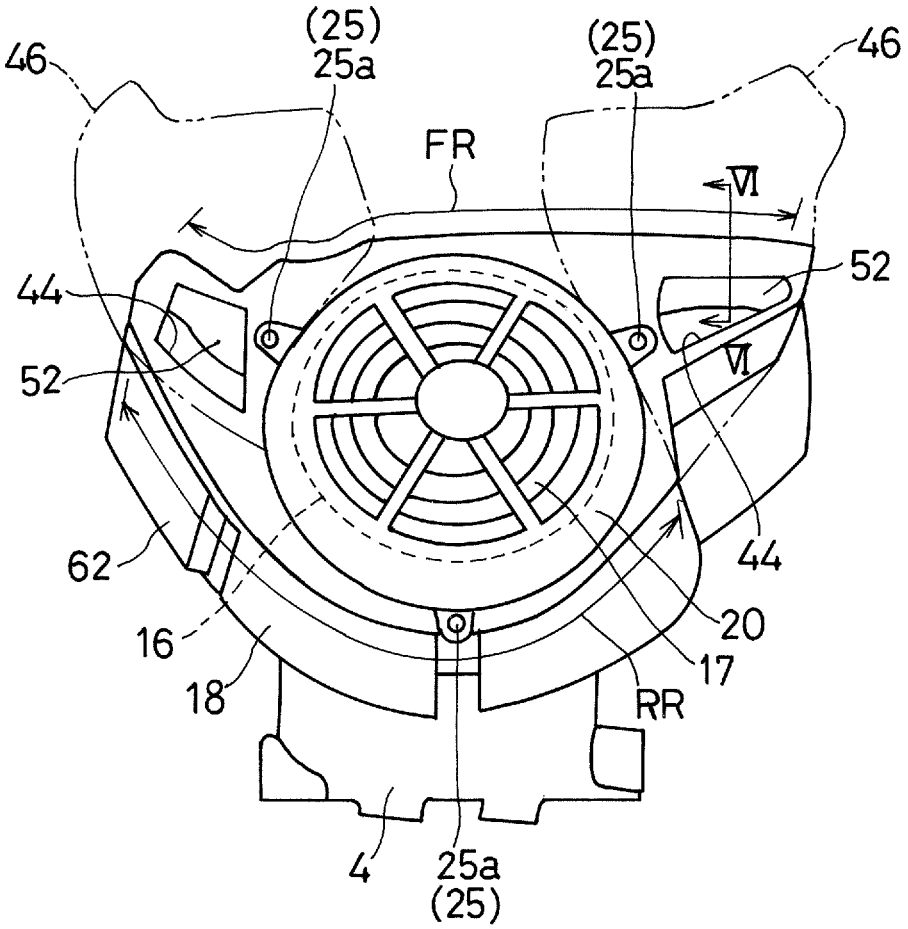
FIG. 3 is a plan view of the engine, with debris covers removed.

As shown in FIG. 3, a fan housing 18 is attached to the crankcase 4. The fan housing 18 is, for example, made of a resin. The material of the fan housing 18, however, is not limited to resins. The fan housing 18 covers an outer periphery and an upper part of the cooling fan 16, except for a front part of the cooling fan, and guides the cooling air W to the cylinder units 6. The fan housing 18 includes an outer side wall so as to surround the radially outside of the engine rotation shaft 2.

A screen cover 20 is attached to an upper side of the fan housing 18. The screen cover 20 covers the rotary screen 17 from above and is fixed to the fan housing 18. The screen cover 20 has a plurality of circular-arc slits defined therein, as shown in FIG. 2. Air A can flow into the fan housing 18 through the slits, whereas foreign matters larger than the slits cannot pass through the screen cover 20. The screen cover 20 is removably attached to the fan housing 18 by a fastening member 25 such as a bolt. Although, in the present embodiment, the screen cover 20 is attached to the fan housing 18 by three fastening members 25 circumferentially provided about 120° apart, the number of the fastening members 25 is not limited to three.

An air cleaner 26 is disposed at a location away from the cylinder units 6 in the axial direction AX of the engine rotation shaft 2, as shown in FIG. 1. In the present embodiment, the air cleaner is disposed above the cylinder units 6. The air cleaner 26 includes a cleaner element (not illustrated) inside a cleaner casing 28 and is configured to introduce and purify (filter) the outside air.

The air A having been purified by the air cleaner 26 passes through an intake pipe 30 and a throttle body 32 and is distributed to respective cylinders by an intake manifold 34 that is branched to the left and right sides. The air cleaner 26 has an outlet to which an upstream end of the intake pipe 30 is connected, and the intake pipe 30 has a downstream end to which an inlet of the throttle body 32 is connected. The throttle body 32 includes: a throttle valve (not illustrated) for adjusting an amount of air to be supplied to the engine inside the throttle body; and an electronic control unit 32*a* for controlling the throttle valve on an outer surface of the throttle body. The structure of the throttle body 32 is not limited to this.

The outlet of the throttle body 32 is connected to the upstream end of the intake manifold 34. The intake manifold 34 is brunched into two passages at an intermediate position in a flow direction of the air, and downstream ends of the passages are connected to the intake ports 10*a* (FIG. 4) of the two cylinder heads 10. The air cleaner 26, the intake pipe 30, the throttle body 32 and the intake manifold 34 cooperate together to constitute the above-described intake system components.

As shown in FIG. 4, the intake manifold 34 has an upstream end connected to an outlet of the throttle body 32 and is then branched into two branch pipes 34*a*. The respective branch pipes 34*a* extend outward in the widthwise direction of the engine and are curved downward so as to be connected to the intake ports 10*a* of the cylinder heads 10. A fuel nozzle or fuel injector 36 is attached to each of the branch pipes 34*a*. The fuel nozzles 36 spray fuel into the intake passages so as to generate an air-fuel mixture, and the air-fuel mixture is supplied to the intake ports 10*a*.

A fuel pump 38 is disposed at one side portion of a front part of the engine in the widthwise direction (i.e., on the left side in FIG. 4). The fuel pump 38 supplies the fuel to the fuel nozzles 36. An outer surface of the fuel pump 38 is covered by a cover 40. The fuel pump 38 is connected to the fuel nozzles 36 through a fuel pipe 42.

As shown in FIG. 3, the fan housing 18 has an upper side on which opening parts 44 are formed for maintenance of the cylinder units 6. There are two such opening parts 44 arranged facing the cylinder units 6, 6 of the respective cylinders. When carrying out maintenance, an air duster can be inserted from the opening parts 44 to remove grass clippings or the like caught by the cylinder units 6.

The opening parts 44 are closed by debris covers 46 as shown in FIG. 2. The debris covers 46 are removably attached to the fan housing 18 by fastening members 45 such as bolts. The opening parts 44 are closed when the debris covers 46 are attached to the fan housing 18, and the opening parts 44 are opened when the debris covers 46 are removed from the fan housing 18 as shown in FIG. 3.

The debris covers 46 in FIG. 2 are, for example, made of a resin. The material of the debris covers 46, however, is not limited to resins. Each of the debris covers 46 has a surface formed with a stepped part 48. Specifically, an inner part of the surface of each debris cover 46 in the widthwise direction is higher than an outer part of the front surface through the stepped part 48.

Figure 5:
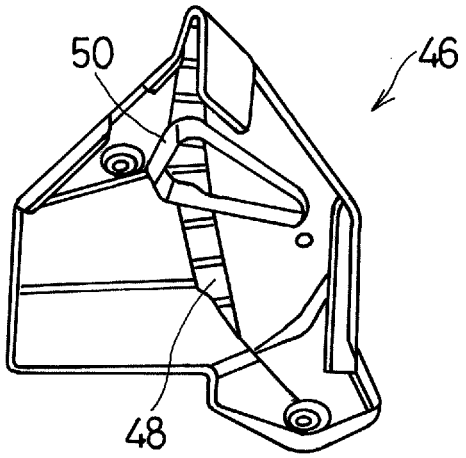
FIG. 5 is a perspective view of a debris cover when viewed from the inside of the debris cover.

As shown in FIG. 5, each of the debris covers 46 has a rear surface or lower surface formed with a plate-like rib 50. FIG. 5 shows the debris cover 46 which is illustrated on the right in FIG. 2. The rib 50 is shaped so as to match one of the opening parts 44 and protrudes downward from the rear surface (lower surface) of the corresponding debris cover 46. When the debris covers 46 shown in FIG. 2 are attached to the fan housing 18, the ribs 50 come into engagement with edges of the opening parts 44. Also, when the debris covers 46 are attached to the fan housing 18, the debris covers 46 conceal head parts 25*a* of the fastening members 25 for the screen cover 20 shown in FIG. 3.

The fan housing 18 is formed with air guide plates 52 that constitute a part of an outer periphery of the fan housing 18. The air guide plates 52 guide the cooling air W (FIG. 6) from the cooling fan 16 to the respective cylinder units 6. The air guide plates 52 are formed in a front region FR and a rear region RR (FIG. 3) of the outer side wall of the fan housing 18.

Figure 6:
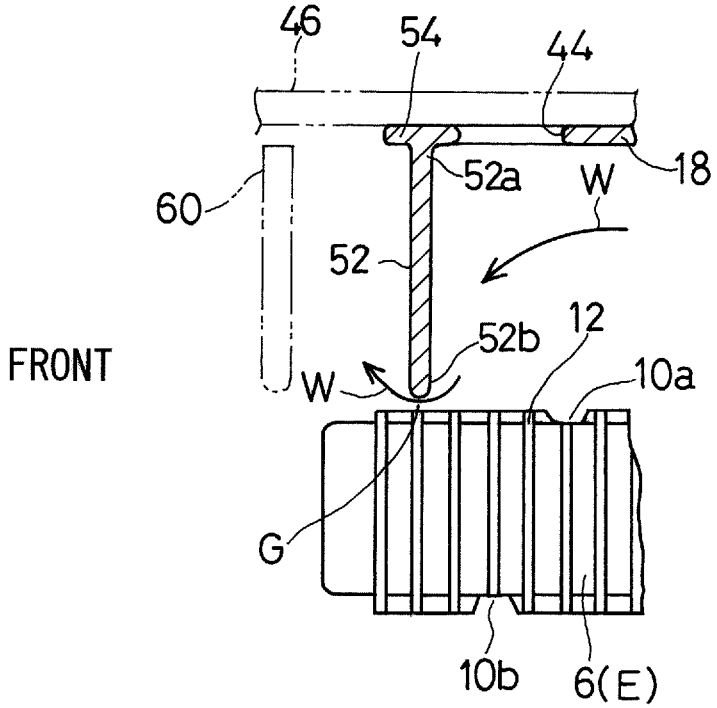
FIG. 6 is a sectional view along line VI-VI shown in FIG. 3.

As shown in FIG. 6, each of the air guide plates 52 includes a proximal end portion 52*a* and a distal end portion 52*b* extending from the proximal end portion 52*a* to the cooling fins 12 of the cylinder units 6. In the present embodiment, the proximal end portions 52*a* of the air guide plates 52 correspond to upper end portions of the air guide plates 52 and are connected to an upper wall of the fan housing 18. In the present embodiment, the distal end portions 52*b* of the air guide plates 52 correspond to lower end portions of the air guide plates 52 and are located in the vicinity of the cylinder units 6. The distal end portions 52*b* of the air guide plates 52 face (upper sides of) the cylinder units 6 through gaps G. The distal end portions 52*b* of the air guide plates 52 may be disposed closer to the exhaust ports 10*b* of the cylinder units 6 than to the intake ports 10*a*.

A reinforcing plate 54 for securing the rigidity of the fan housing 18 is formed at the proximal end portions 52*a* of the air guide plates 52. Specifically, the fan housing 18 may have an edge part frontward of the opening parts 44, the edge part having a T-shaped cross section. A horizontal portion of the edge part having the T-shaped cross section constitutes the reinforcing plate 54, and a vertical portion of the edge part constitutes the air guide plate 52.

Figure 7:
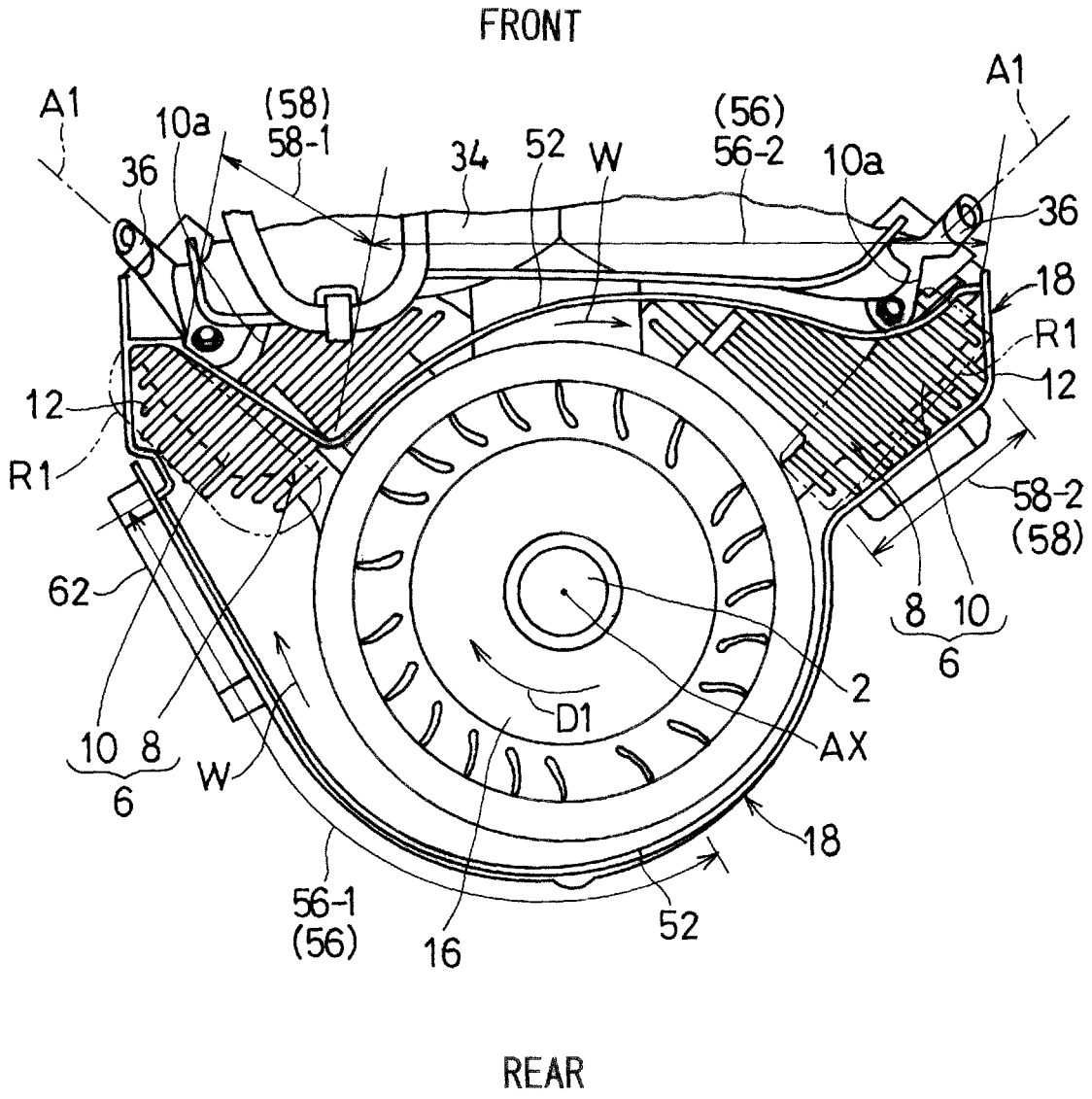
FIG. 7 shows a plan view of FIG. 4, with air guide plates added.

As shown in FIG. 7, the air guide plates 52 include a pair of collecting walls 56, 56 on the front and rear sides and a pair of impingement walls 58, 58 provided correspondingly to the pair of collecting walls 56, 56. The collecting walls 56 collect a part of the cooling air W flowing from the cooling fan 16 in a radiating manner and distribute the cooling air to the corresponding cylinder units 6. The collecting walls includes a first collecting wall 56-1 for distributing the cooling air W to one of the cylinder units 6 (on the left side in FIG. 7) and a second collecting wall 56-2 for distributing the to the other of the cylinder units 6 (on the right side in FIG. 7). Each of the pair of collecting walls 56-1, 56-2 has a so-called snail shape, i.e., is curved so as to extend away from a rotation axis (axis of the engine rotation shaft) AX of the cooling fan 16 in a circumferential direction of a rotation direction D1 of the cooling fan 16.

The impingement walls 58 includes a first impingement wall 58-1 corresponding to the first collecting wall 56-1 and a second impingement wall 58-2 corresponding to the second collecting wall 56-2. The pair of impingement walls 58 are disposed to confront the corresponding collecting walls 56 with cylinder-opposing regions R1. As used herein, the term "cylinder-opposing region R1" refers to a region which extends along an axis A1 of one of the cylinder units 6 and is located between the collecting wall 56 and the corresponding impingement wall 58 in a plan view. An oil cooler 62 is disposed adjacent to one of the cylinder-opposing regions R1.

The impingement walls 58 deflect the cooling air W collected by the collecting walls 56 and guide the cooling air W along the cylinder-opposing regions R1. In the present embodiment, the first collecting wall 56-1 and the second impingement wall 58-2 are connected to each other, and the second collecting wall 56-2 and the first impingement wall 58-1 are connected to each other.

The fuel nozzle 36 is disposed on a side opposite to the engine rotation shaft 2 with respect to the air plate 52. An intake-side cover 60 is disposed on an outer side with respect to the fuel nozzles 36 in the radial direction of the axis AX of the engine rotation shaft 2 so as to cover the intake manifold 34, the fuel nozzles 36 and the like. The intake-side cover 60 is, for example, removably attached to the intake manifold 34. Also, as shown in FIG. 2, each of the debris covers 46 extends over one of the air guide plate 52 to the side opposite to the engine rotation shaft 2 when viewed from the axial direction AX of the engine rotation shaft 2.

The oil cooler 62 is disposed in the vicinity of an outlet of the cooling air W on the outer side wall of the fan housing 18 shown in FIG. 7. Specifically, the oil cooler 62 is attached to an outer surface of the first collecting wall 56-1 on a tip-end side (an outlet side) in a direction in which the cooling air W is guided.

Flow of the cooling air in the present embodiment will be described. When the engine E shown in FIG. 2 is started and causes the crankshaft 2 to rotate, the cooling fan 16 and the rotary screen 17 also rotate integrally with the crankshaft 2. As the cooling fan 16 rotates, cooling air W is generated in a centrifugal direction so that pressure inside the fan housing 18 increases. Specifically, air A is sucked into the fan housing 18 from above through the screen cover 20 and the screen 17 as the cooling air W. The cooling air W is guided downward in the fan housing 18 so as to cool cooling target components such as the cylinder units 6, 6. Although grass clippings smaller than the slits of the screen cover 20 may pass through the fan cover 20, they will be finely shredded by the rotary screen 17 and discharged outside from a gap between the crankcase 4 and the fan housing 18.

The above-described snail shape generates a pressure difference inside the fan casing 18, and the flow of the cooling air W is directed from the centrifugal direction to the circumferential direction along the snail shape. Specifically, as shown in FIG. 7, the cooling air W is guided by the pair of collecting walls 56 on the front and rear sides and distributed to the corresponding cylinder units 6. The impingement walls 58 deflect the cooling air W guided by the collecting walls 56 and guide the cooling air W along the cylinder-opposing regions R1. The collecting walls 56 and the corresponding impingement walls 58 increase the pressure in the cylinder-opposing regions R1. The high-pressure cooling air W passes beyond the air guide plates 52 through gaps G (FIG. 6) and flows along the cooling fins 12 located frontward of the air guide plates 52 so as to cool the cylinder units 6. Also, a part of the high-pressure cooling air W cools the oil cooler 62 shown in FIG. 7.

According to the above configuration, the fan housing 18 is formed with the air guide plates 52 that constitute a part of an outer periphery of the fan housing; the distal end portions 52*b* of the air guide plates 52 (FIG. 6) extend to the cooling fins 12 of the cylinder units 6; and the reinforcing plate 54 is formed at the proximal end portion 52*a* of the air guide plate 52. Thus, even where larger opening parts 44 are provided in order to facilitate maintenance, the rigidity of the fan housing 18 is ensured thanks to the air guide plates 52 and the reinforcing plate 54. The air guide plates 52 also improve cooling of the engine E.

As shown in FIG. 5, each of the debris covers 46 has a rear surface formed with a rib 50 to be engaged with one of the opening parts 44. Thus, the ribs 50 improve the rigidity of the debris covers 46 and serve as guides when attaching the debris covers 46, and therefore, workability in attaching the debris covers can be improved. The ribs 50 can also suppress leakage of air from the opening parts 44 so that cooling is improved. Further, the debris covers 46 are formed with the stepped parts 48, and therefore, the rigidity of the debris covers 46 can be improved.

The debris covers 46 conceal the head parts 25*a* of the fastening members 25, which are shown in FIG. 2, for attaching the screen cover 20 to the fan housing 18. This provides good appearance since the fastening members 25 are not exposed, and also prevents contact with peripheral components so that the fastening members 25 are less likely to become loose, making it possible to suppress detachment of the screen cover 20.

As shown in FIG. 7, the fuel nozzles 36 are provided on the sides opposite to the engine rotation shaft 2 with respect to the respective air guide plate 52, and the intake-side cover 60 shown in FIG. 6 is disposed on the outer side of the fuel nozzles 36 (on a side opposite to the engine rotation shaft 2). Thus, the fuel nozzles 36 are located on the outer side of the fan housing 18, and therefore, maintenance of the fuel nozzles 36 can be facilitated.

As shown in FIG. 4, in a V-type two-cylinder engine in which the axis AX of the engine rotation shaft 2 extends in the vertical direction, the two opening parts 44 shown in FIG. 3 are provided above the cylinder units 6, 6 of the respective cylinders. This makes it easy to remove grass clippings accumulated on the cooling fins 12 shown in FIG. 4 through the opening parts 44.

As shown in FIG. 7, the oil cooler 62 is disposed in the vicinity of an outlet of the cooling air W on the outer wall of the fan housing 18, i.e., in the vicinity of one of the cylinder-opposing regions R1. Thus, the high-pressure cooling air W is guided to the oil cooler 62 so as to effectively cool the oil cooler 62.

As shown in FIG. 6, the distal end portions 52*b* of the air guide plates 52 extend to the cooling fins 12 of the cylinder units 6. Thus, the cooling air W from the cooling fan 16 can be efficiently guided to the cooling fins 12 of the respective cylinders so that cooling is improved.

The distal end portions 52*b* of the air guide plates 52 are disposed closer to the exhaust ports 10*b* of the cylinder units 6 than to the intake ports 10*a*. This makes it possible to efficiently guide the cooling air W to parts of the cooling fins 12, which parts are located in the vicinity of the exhaust ports 10*b* and have a higher temperature, so that cooling is improved.

Since the cooling fan 16 shown in FIG. 7 is a centrifugal fan configured to feed the cooling air radially outward from the engine rotation shaft 2 in a radiating manner, the air guide plates 52 can smoothly guide the cooling air W. Also, the air guide plates 52 include the pair of front and rear collecting walls 56 configured to collect a part of the cooling air W flowing from the centrifugal fan 16 in a radiating manner and to distribute the cooling air to the cylinder units 6, and each of the pair of collecting walls 56 is curved so as to extend away from the rotation shaft (engine rotation shaft) 2 of the centrifugal fan 16 in a circumferential direction of the rotation direction D1 of the centrifugal fan 16. Thus, the snail-shape collecting walls 56 matching the two cylinder units 6 can rectify the cooling air W radiated by the centrifugal fan 16 in the centrifugal direction and distribute the cooling air W to both the cylinders so that cooling is improved.

The air guide plates 52 further include the pair of impingement walls 58 provided correspondingly to the pair of collecting walls 56; the pair of impingement walls 58 are disposed with respect to the corresponding collecting walls 56 across the cylinder-opposing regions R1 along the cylinder axes A1; and the pair of impingement walls 58 deflect the cooling air W collected by the collecting walls 56 so as to guide the cooling air along the cylinder-opposing regions R1. Provision of such impingement walls 58 makes it easy to deflect the cooling air W guided by the collecting wall 56 so as to direct the cooling air in the directions along the cylinder axes A1. As a result, cooling of the cylinder units 6 is improved.

The first collecting wall 56-1 configured to distribute the cooling air W to one of the cylinder units 6 (on the left side in FIG. 7) is formed connectedly to the second impingement wall 58-2 corresponding to the second collecting wall 56-2 configured to distribute the cooling air W to the other of the cylinder units 6 (on the right side in FIG. 7). The second collecting wall 56-2 is formed connectedly to the first impingement wall 58-1 corresponding to the first collecting wall 56-1. Thus, it is possible to form the air guide plates 52 as constituting members of the outer periphery of the fan housing 18 and to enhance the rigidity.

Each of the debris covers 46 extends over one of the air guide plates 52 to the side opposite to the engine rotation shaft 2 in a plan view shown in FIG. 3. Thus, the debris covers 46 extend over the air guide plate 52, and therefore, the debris covers 46 can protect the fuel nozzles 36 etc.

The present invention is not intended to be limited to the above embodiment, and various addition, changes, or deletions may be made without departing from the scope of the invention. For example, although the above embodiment has been described with reference to a V-type two-cylinder engine, the cover structure of the present invention may also be applied to engines other than V-type two-cylinder engines. Accordingly, such variants should also be included within the scope of the present invention.

REFERENCE NUMERALS

2 . . . Engine rotation shaft (crankshaft)
6 . . . Cylinder unit
10*a* . . . Intake port
10*b* . . . Exhaust port
12 . . . Cooling fin
16 . . . Cooling fan (centrifugal fan)
18 . . . Fan housing
20 . . . Screen cover
25 . . . Fastening member
25*a* . . . Head part of the fastening member
36 . . . Fuel nozzle
44 . . . Opening part
46 . . . Debris cover
48 . . . Stepped part
50 . . . Rib
52 . . . Air guide plate
52*a* . . . Proximal end portion of the air guide plate
52*b* . . . Distal end portion of the air guide plate
54 . . . Reinforcing plate
56 . . . Collecting wall
56-1 . . . First collecting wall
56-2 . . . Second collecting wall
58 . . . Impingement wall
58-1 . . . First impingement wall
58-2 . . . Second impingement wall
60 . . . Intake-side cover
62 . . . Oil cooler
A1 . . . Cylinder axis
AX . . . Axis of the engine rotation shaft
E . . . Engine
R1 . . . Cylinder-opposing region

What is claimed is:

1. A cover structure for an air-cooled engine to be cooled by cooling air generated by a cooling fan, the cover structure comprising:

a fan housing covering the cooling fan and configured to guide the cooling air to a cylinder unit, the fan housing being formed with an opening part for maintenance of the cylinder unit;

a debris cover removably attached to the fan housing so as to close the opening part;

an air guide plate formed in the fan housing and configured to constitute a part of an outer periphery of the fan housing, the air guide plate including a proximal end portion and a distal end portion extending from the proximal end portion to a cooling fin of the cylinder unit; and a reinforcing plate for securing rigidity of the fan housing, the reinforcing plate being formed at the proximal end portion of the air guide plate, wherein the opening part faces the cylinder unit, and the debris cover extends over the air guide plate to a side opposite to a rotation shaft of the engine when viewed from an axial direction of the rotation shaft of the engine.

2. The cover structure as claimed in claim 1, wherein the debris cover has a rear surface formed with a rib to be engaged with the opening part.

3. The cover structure as claimed in claim 1, further comprising a screen cover removably attached to the fan housing by a fastening member and configured to prevent foreign matters from approaching the cooling fan, wherein a head part of the fastening member is concealed by the debris cover.

4. The cover structure as claimed in claim 1, wherein the engine is a V-type engine having two cylinders each having the cylinder unit, and the fan housing has two said opening parts facing the cylinder units of the cylinders.

5. The cover structure as claimed in claim 4, wherein an oil cooler is disposed in the vicinity of a cooling air outlet on an outer wall of the fan housing.

6. The cover structure as claimed in claim 4, wherein the distal end portion of the air guide plate extends to respective cooling fins of the two cylinders.

7. The cover structure as claimed in claim 6, wherein the distal end portion of the air guide plate is disposed closer to exhaust ports of the cylinder units than to intake ports of the cylinder units.

8. The cover structure as claimed in claim 1, wherein the cooling fan is a centrifugal fan configured to feed the cooling air radially outward from the rotation shaft of the engine in a radiating manner.

9. The cover structure as claimed in claim 8, wherein the engine is a V-type engine having two cylinders each having the cylinder unit, the air guide plate includes a pair of collecting walls configured to collect a part of the cooling air flowing from the centrifugal fan in the radiating manner and to distribute the collected cooling air to the two cylinder units, and each of the pair of collecting walls is curved so as to extend away from a rotation shaft of the centrifugal fan in a circumferential direction of a rotation direction of the centrifugal fan.

10. The cover structure as claimed in claim 9, wherein the air guide plate includes a pair of impingement walls provided correspondingly to the pair of collecting walls, and the pair of impingement walls are disposed to confront the corresponding collecting walls with cylinder-opposing regions extending along axes of the cylinders being positioned therebetween, the pair of impingement walls being configured to deflect the cooling air collected by the collecting walls so as to guide the cooling air along the cylinder-opposing regions.

11. The cover structure as claimed in claim 10, wherein the collecting walls include a first collecting wall configured to distribute the cooling air to one of the cylinder units and a second collecting wall configured to distribute the cooling air to the other of the cylinder units, the impingement walls may include a first impingement wall formed in the first collecting wall and a second impingement wall formed in the second collecting wall, and the first collecting wall and the second impingement wall are connected to each other, and the second collecting wall and the first impingement wall are connected to each other.

12. The cover structure as claimed in claim 1, wherein the debris cover has a surface formed with a stepped part.

13. The cover structure as claimed in claim 1, further comprising a screen cover removably attached to the fan housing by a fastening member and configured to prevent foreign matters from approaching the cooling fan, wherein the fan housing has an edge part of the opening parts, which edge part is positioned away from the rotation shaft of the engine in a direction perpendicular to the axial direction of the rotation shaft and has a T-shaped cross section, and a horizontal portion of the edge part having the T-shaped cross section constitutes the reinforcing plate, and a vertical portion of the edge part constitutes the air guide plate.

14. The cover structure as claimed in claim 1, wherein the cylinder unit includes:

a cylinder coupled to a crankcase and protruding crankcase; and a cylinder head coupled to a protruding end portion of the cylinder.

15. A cover structure for an air-cooled engine to be cooled by cooling air generated by a cooling fan, the cover structure comprising:

a fan housing covering the cooling fan and configured to guide the cooling air to a cylinder unit, the fan housing being formed with an opening part for maintenance of the cylinder unit;

a debris cover removably attached to the fan housing so as to close the opening part;

an air guide plate formed in the fan housing and configured to constitute a part of an outer periphery of the fan housing, the air guide plate including a proximal end portion and a distal end portion extending from the proximal end portion to a cooling fin of the cylinder unit; and a reinforcing plate for securing rigidity of the fan housing, the reinforcing plate being formed at the proximal end portion of the air guide plate, wherein the engine includes a fuel nozzle disposed on a side opposite to a rotation shaft of the engine with respect to the air guide plate, and an intake-side cover is disposed on an outer side of the fuel nozzle so as to cover the fuel nozzle.

* * * * *